United States Patent [19]

Haas et al.

[11] Patent Number: 4,465,329

[45] Date of Patent: Aug. 14, 1984

[54] STORAGE CABINET TRAVEL LOCK

[75] Inventors: Robert T. Haas; Lawrence W. Howard, both of Huntsville, Ala.

[73] Assignee: The United States of America as represented by the Secretary of the Army, Washington, D.C.

[21] Appl. No.: 475,417

[22] Filed: Mar. 15, 1983

[51] Int. Cl.[3] ..... E05B 65/46

[52] U.S. Cl. ..... 312/216; 211/4; 292/259 R; 312/348

[58] Field of Search ..... 312/216, 333, 217, 348; 211/4, 129; 292/259

[56] References Cited

U.S. PATENT DOCUMENTS

| | | | |
|---|---|---|---|
| 3,002,800 | 10/1961 | McMahan | 292/259 |
| 3,883,199 | 5/1975 | Cawley, Jr. et al. | 312/216 |
| 3,902,603 | 9/1975 | Wilson | 211/4 |

*Primary Examiner*—William E. Lyddane
*Assistant Examiner*—Joseph Falk
*Attorney, Agent, or Firm*—Anthony T. Lane; Robert P. Gibson; Harold W. Hilton

[57] ABSTRACT

A locking device for retaining a plurality of drawers in secured relation in a cabinet even while the cabinet is transported over rough terrain. The device includes a rod which is rotatable into and out of engagement with the drawers for releasably securing the drawers.

Figure 1:
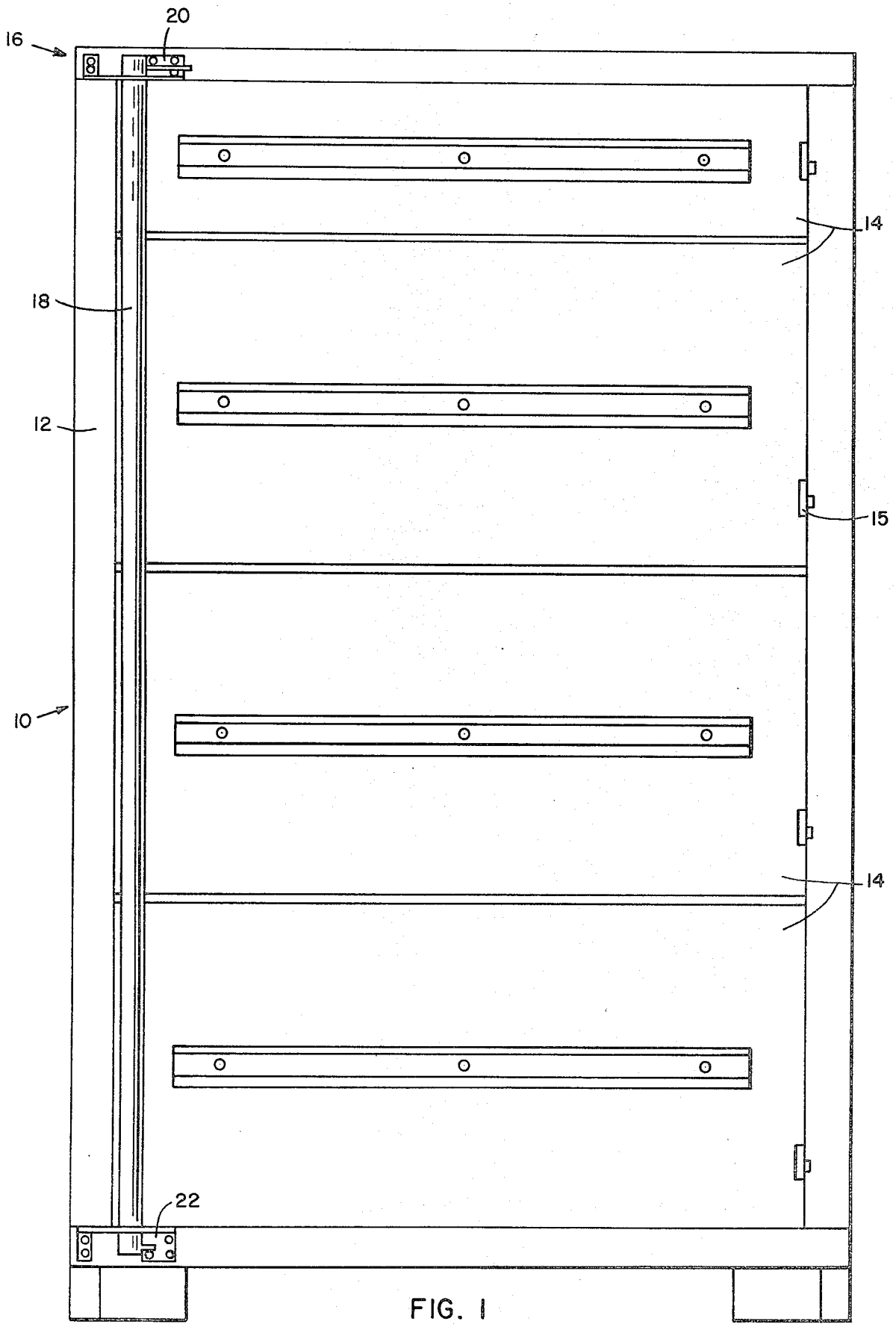
Figure 3:
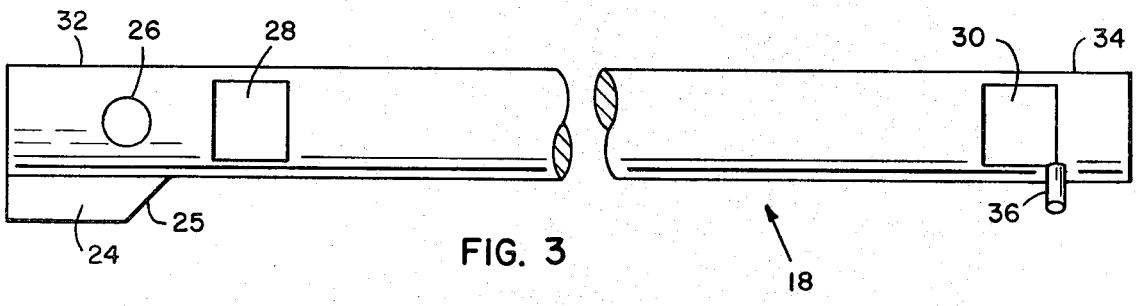
Figure 2:
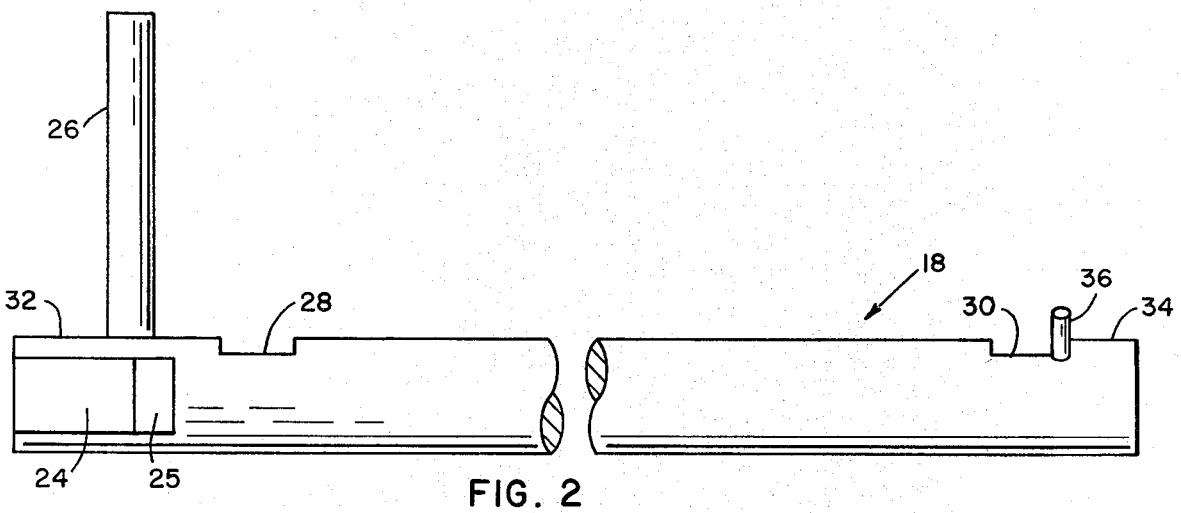
Figure 4:
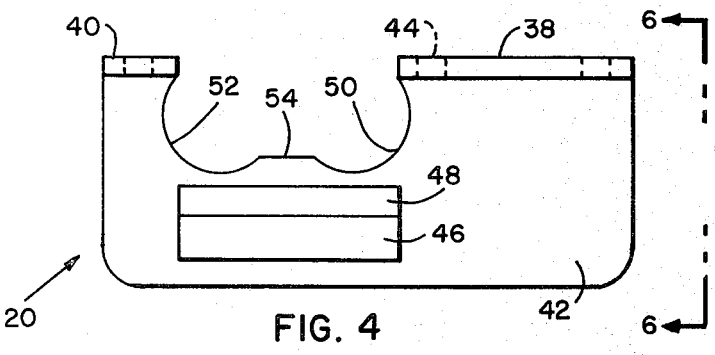
Figure 5:
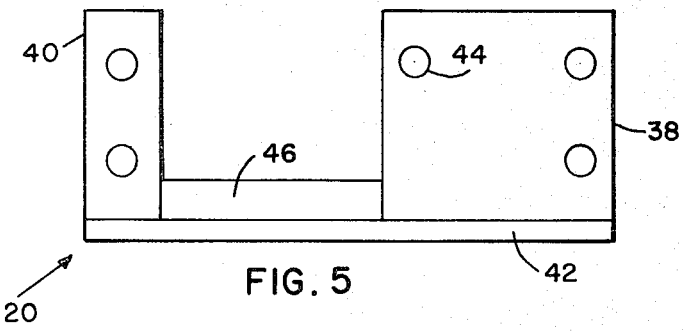
Figure 6:
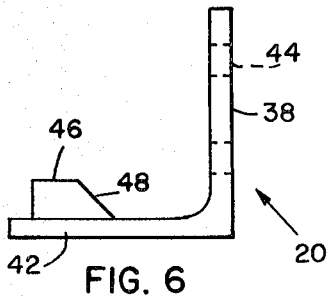
Figure 7:
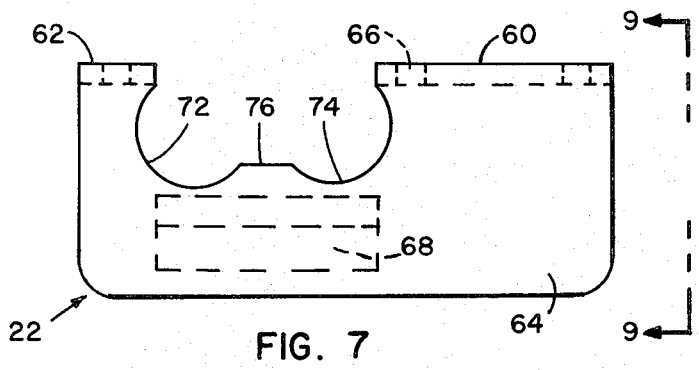
Figure 8:
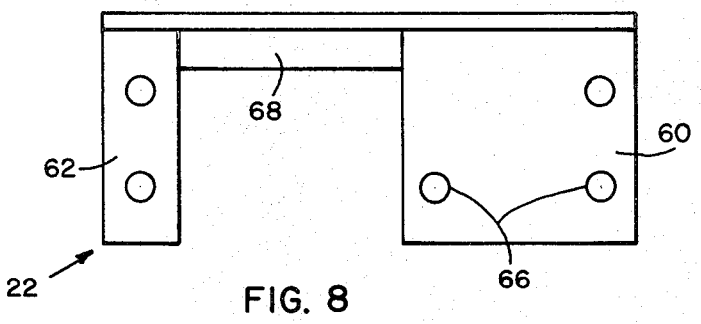
Figure 9:
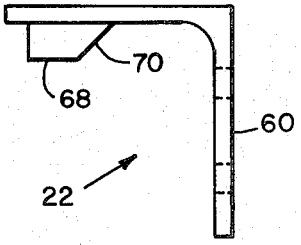
Figure 10:
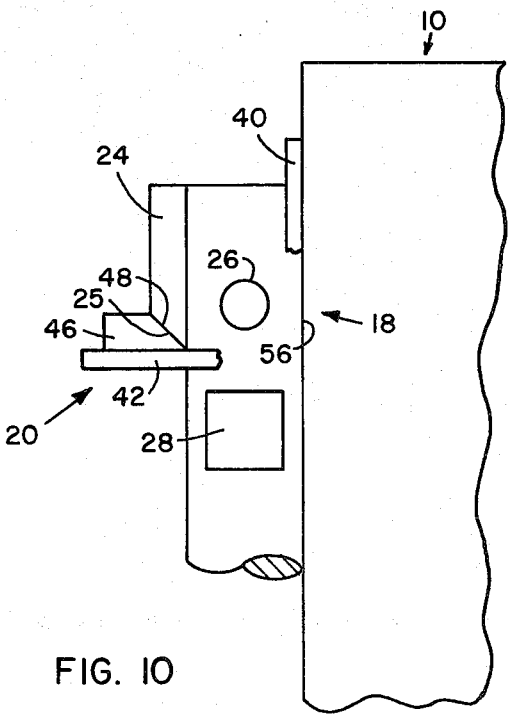

4 Claims, 10 Drawing Figures